US009341444B2

(12) United States Patent
Levine et al.

(10) Patent No.: US 9,341,444 B2
(45) Date of Patent: May 17, 2016

(54) THERMAL ELECTRIC IMAGES

(76) Inventors: Robert Levine, Hauppauge, NY (US); John A. Kennedy, Hauppauge, NY (US)

( * ) Notice: Subject to any disclaimer, the term of this patent is extended or adjusted under 35 U.S.C. 154(b) by 1454 days.

(21) Appl. No.: 11/344,980

(22) Filed: Feb. 1, 2006

(65) Prior Publication Data

US 2009/0214804 A1 Aug. 27, 2009

Related U.S. Application Data

(60) Provisional application No. 60/739,126, filed on Nov. 23, 2005.

(51) Int. Cl.
*F41H 3/00* (2006.01)
*F41J 2/02* (2006.01)

(52) U.S. Cl.
CPC ... *F41H 3/00* (2013.01); *F41J 2/02* (2013.01); *Y10T 428/24802* (2015.01)

(58) Field of Classification Search
CPC ..... F41J 2/00; F41J 2/02
See application file for complete search history.

(56) References Cited

U.S. PATENT DOCUMENTS

| | | | | |
|---|---|---|---|---|
| 4,240,212 | A | 12/1980 | Marshall et al. | |
| 4,253,670 | A | 3/1981 | Moulton et al. | |
| 4,260,160 | A | 4/1981 | Ejnell et al. | |
| 4,279,599 | A | 7/1981 | Marshall et al. | |
| 4,346,901 | A | 8/1982 | Booth | |
| 4,405,132 | A | 9/1983 | Thalmann | |
| 4,428,583 | A | 1/1984 | Feagle | |
| 4,470,818 | A | 9/1984 | Marshall | |
| 4,505,481 | A | 3/1985 | Knight | |
| 4,546,983 | A * | 10/1985 | Rosa | 273/348.1 |
| 4,605,232 | A | 8/1986 | Hundstad | |
| 4,607,849 | A | 8/1986 | Smith et al. | |
| 4,639,603 | A | 1/1987 | Pistor | |
| 4,706,963 | A | 11/1987 | Geuss | |
| 4,767,122 | A | 8/1988 | Rusche | |
| 4,792,142 | A | 12/1988 | Davies | |
| 4,799,688 | A | 1/1989 | Kellman et al. | |
| 4,832,451 | A | 5/1989 | Trescott | |
| 4,883,971 | A | 11/1989 | Jensen | |
| 4,922,116 | A | 5/1990 | Grinberg et al. | |
| 4,946,171 | A | 8/1990 | Merle et al. | |
| 4,967,091 | A | 10/1990 | Fair et al. | |
| 5,065,032 | A | 11/1991 | Prosser | |
| 5,066,019 | A | 11/1991 | Dean et al. | |
| 5,110,137 | A | 5/1992 | Watkins et al. | |
| 5,126,577 | A | 6/1992 | Trent | |
| 5,224,860 | A | 7/1993 | Waldman et al. | |
| 5,229,910 | A * | 7/1993 | Kasahara | 361/234 |
| 5,296,270 | A | 3/1994 | Prosser | |
| 5,321,263 | A | 6/1994 | Filo | |
| 5,394,824 | A | 3/1995 | Johnson, Jr. | |
| 5,397,236 | A | 3/1995 | Fegg et al. | |
| 5,599,023 | A | 2/1997 | Loyd | |
| 5,693,951 | A | 12/1997 | Strong, III | |
| 5,838,014 | A | 11/1998 | Cabib et al. | |
| 5,901,959 | A | 5/1999 | Tessiot | |
| 5,924,694 | A | 7/1999 | Kent | |
| 6,315,294 | B1 | 11/2001 | Belleville | |
| 6,337,475 | B1 | 1/2002 | Migliorini | |
| 6,338,292 | B1 | 1/2002 | Reynolds et al. | |
| 6,414,332 | B1 | 7/2002 | Lin et al. | |
| 6,482,520 | B1 | 11/2002 | Tzeng | |
| 6,734,448 | B2 | 5/2004 | Kongable | |
| 6,767,015 | B1 * | 7/2004 | Parsley | 273/348.1 |
| 7,102,814 | B1 | 9/2006 | Hughes | |
| 7,377,517 | B2 | 5/2008 | Andren et al. | |
| 2005/0052310 | A1 | 3/2005 | Snaper | |
| 2005/0150740 | A1 * | 7/2005 | Finkenzeller et al. | 194/207 |

FOREIGN PATENT DOCUMENTS

| | | | |
|---|---|---|---|
| FR | 2826188 | A1 | 12/2002 |
| JP | 7120197 | A | 5/1995 |
| WO | WO 03054808 | A2 * | 7/2003 |
| WO | 2007008414 | A2 | 7/2007 |

OTHER PUBLICATIONS http://www.physlink.com/Education/AskExperts/ae430.cfm (obtained Mar. 24, 2014).*

Norley et al, The Development of Natural Graphite Heat Spreaders, 17th IEEE SEMI-THERM Symposium, Mar. 2001.

SMALC, Thermal Performance of Natural Graphite Heat Spreaders, Proceedings of IPACK, ASME InterPACK, Jul. 17-22, 2005, pp. 1-11.

* cited by examiner

*Primary Examiner* — Gerard Higgins
*Assistant Examiner* — Sathavaram I Reddy
(74) *Attorney, Agent, or Firm* — Lee Grosskreuz Hechtel; Alfred M. Walker

(57) ABSTRACT

This disclosure relates to thermal electric images which may form Informational Images such as landing zone markers, drop zone markers, vehicle markers, road markers, covert signs, notices, directions and the like, and may also be used to form thermal targets which may be used as training aides for weapons and other devices that are equipped with thermal imaging equipment.

20 Claims, No Drawings

THERMAL ELECTRIC IMAGES

PRIORITY

This application is related to provisional patent application 60/739,126 which was filed on Nov. 23, 2005.

FIELD OF THE INVENTION

This disclosure relates to thermal electric images which may be employed for military, law enforcement, fire and rescue departments, first responders, and recreational use, which may be manufactured at low cost for large volume utilization.

BACKGROUND OF THE INVENTION

Thermal imaging sensors have been available to the military and law enforcement, however, the technology to convert invisible heat energy into a visible image has been considered exotic, based on exorbitant costs and somewhat limited availability. The ungainly physical size and excessive price has limited the use of thermal imaging technology in the field to elite forces and highly specialized surveillance equipment. Recent advances in technology now allow this technology to be offered in a lower cost and smaller, lighter-weight physical unit or package. As a result, imaging sensors are used as aiming devices for standard weapons by a much larger number of individuals in the military and law enforcement. It would be advantageous, especially in military applications, to provide informational images, such as landing zone markers, road markers, signs, notices and the like, to military personal which is visible and legible only to those in possession of advanced sensor equipment. In addition, individuals equipped with thermal imaging and aiming tools may require training aides, practice targets, and the like, that will allow them to master the use of thermal imaging weapon sights.

SUMMARY

Thermal Images providing information, such as landing zone markers, drop zone markers, vehicle markers, road marker, covert signs, notices or directions, and practice targets may be designed with single or multiple continuous lines that are printed with an ink or paint having conductive properties. In another embodiment, conductive foils or other metallic materials may be employed to form a pattern in addition to the conductive inks. The thermal image may include at least one conductive media, at least one non-conductive substrate, and at least one power source. The at least one conductive media may be selected from a group consisting essentially of conductive foil, metallic materials, conductive media conductively-doped materials and combinations thereof. The Informational Images may be inexpensively made and formed on media such as, for example, paper, cloth, plastics, vinyl or cardboard, and the like. The media may also be laminated if desired. The ink, and the foils, can radiate thermal energy when a current is passed through the pattern and thermal radiation produces a visible image when viewed with a thermal sensor imaging vision system. This technique allows for the creation of an extremely low cost, disposable thermal image which may be visible to only select and limited personnel. In addition, imaging training aides for use with a weapons site sight equipped with thermal imaging capabilities may be economically produced to train personnel on new equipment and align such equipment.

DETAILED DESCRIPTION

This disclosure relates to thermal electric images which may form Images providing information such as landing zone markers, drop zone markers, road markers, covert signs, notices, directions and the like, and may also be used to form thermal targets which may be used as training aides for weapons and other devices that are equipped with thermal imaging equipment (collectively referred to herein as "Informational Images"). Thermal electric Images or Informational images may have many military and law enforcement applications to provide information that would be visible, and readily available, only to a select and limited number of personnel having access to and training with thermal sensor/imaging equipment and devices. These informational Images may, therefore, allow covert visual communications in open locations, including road sides, intersections and hostile areas, since the Informational Image is entirely invisible without the required training and equipment. The informational Image may, for example, relay information on the direction of troop movements, the presence of local insurgents, hostile groups or mines, a particular roadway (or trail) to follow or avoid, and the like. The information relayed may be written or pictorial, such as, for example, directional arrows, which may be readily employed in a wide variety of situations and circumstances. The Informational Images may, if desired, include visible decoy portions that portray local signs or traffic signs to distract from the actual purpose of the Informational Image and deter local inhabitants from removing it.

The Informational Image may, for example, be used to covertly mark a landing zone or a drop zone for a helicopter or marine vessel. The covert mark or marker may be applied to any material, including a material that may be rolled or folded such as a vinyl or similar material. The covert marker may be deployed in the desired location and visible only to the pilot, or other personnel, of a marine vessel, fixed wing aircraft or helicopter, when viewed through a thermal imager. The image on the marker is invisible to the naked eye or to enemy combatants that equipped with standard night vision technologies. Use of this marker may minimize the possibility of the position being compromised by enemy positions and thus increase the safety of a covert operation. The thermal pattern marker may be generated by a variety of methods, including, but not limited to, conductive laminates, embedded conductive wires or chemically reactive thermal agents or materials, as well as conductive inks and paints.

Where chemical reactive agents or a chemical power source is used, the reactive agent may typically be applied to a substrate in a desired or specific pattern. The type and amount of chemical agent may be determined by the intended use of the Informational Image or marker. The agent or agents forming the pattern may be protected from exposure to air and sealed by any convenient means. Upon exposure to air, the chemical agent reacts with the air, and typically reacts with the oxygen, to produce thermal emission during the reaction period. The thermal emission formed by the reaction can produce a pattern that is visible via thermal sensor equipment.

In one embodiment, a thermal landing zone or drop zone marker may be applied to the technology to a portable field stretcher or Sked® stretcher or litter (which is manufactured by Skedco, Inc. of Portland, Oreg. 97281 USA). Portable stretchers are often available in battle field environments. This alternate use could give them a dual purpose and therefore minimizing the amount of equipment that is necessary to be deployed in battle.

The Informational Image may be used as a marker to covertly mark a convoy or any vehicle or vessel of interest.

The marker may be affixed to the vessel, vehicle or a fixed structure permanently or temporarily with fasteners, adhesives, magnets or the like. The marker may be may be powered by the vehicle self powered as described below.

The Informational image or marker may be created to generate an identifying alpha-numeric call insignia that may be affixed to the top of a vehicle or vessel, such as a law enforcement or military vehicle or vessel. The identifying marker may be designed to be covert generating an image that is only visible with a thermal imager. It may also be layered or overlaid with a visible marker as well as a thermal marker that would allow a user to view the identifying marker visually or with a thermal imaging camera. The visible and thermal patterns may be formed concurrently, or one may be formed and then the second image formed over it, while allowing both patterns to be thermally and visually useful and legible. The marker can provide a readily recognizable image to locate and identify the vehicle or vessel from a distance, whether from the air or the ground. The thermal images displayed by a marker may differ from the visual image to provide additional covert information, or the thermal and visual images may be similar or the same to be viewed via differing equipment or the naked eye.

Multiple and different thermal patterns may be applied to the same marker allowing the operator to select one or more of the patterns to be activated in the field. Multiple patterns allow the marker to be utilized in a more secure fashion by giving the operator the ability to select among previously determined, and possibly secret, coded pattern of the day to signal others. Multiple patterns may also prevent the marker from being utilized by enemy combatants if the marker fell into enemy hands. The marker would be rendered useless to those unfamiliar with, or lacking knowledge, of a predefined marker pattern and would also serve to mark the enemy location as a target, where the marker was visible.

In addition, the informational image or marker may include a pattern formed of a conductive foil; metallic materials, conductive media conductively-doped materials and combinations thereof (referred to herein as "conductive media") to provide a thermal electric image to be viewed via thermal sensor equipment and is also reflective for visual recognition. Any convenient power source may be employed, such as, for example, solar or coin batteries, batteries that withstand exposure in the field, or any other convenient power source.

The Informational Image may be formed into the shape of a target, and these thermal targets may be used, inter alia, to train personnel with thermal sensor equipment and to monitor the alignment of the imaging equipment by determining any shift in the intended trajectory of ammunition impacting the target. A thermal target may be used in an identical fashion to a standard paper target that is commonly used with optical weapons sights on a target range. Military and law enforcement personnel may employ thermal imaging equipment to become familiar and proficient with thermal sensor equipment by aiming a weapon or device at a target image for training and practice purposes while using thermal sensor(s) to visualize a target. Others may also use such thermal imaging equipment for recreational purposes.

The disclosed Informational Images are produced by thermal emission, rather than by light emitted or reflected in the visible spectrum. The thermal emission of an Informational Image is translated into a visible image via a thermal sensor, or thermal imaging device, to provide the user with a comprehensive image or "picture". Where Informational Images are employed remotely in the field, the electric source may be such as, for example, a solar battery or a coin cell. Where the informational Images are used in a controlled environment or as a target, electrical contacts may be attached to the target media at pre-defined positions designed into the pattern so as to create a complete electrical circuit when a voltage source is applied. The mechanical contacts may be easily detached for replacing target media and designed into the target support device.

The informational Image may be formed with disposable and inexpensive materials for use with thermal imaging sight equipped weapons or any thermal imaging device. The Informational Image has the unique, novel quality of achieving varying thermal profiles by using an electric current passing through a printed or painted pattern as a power source in some embodiments. A choking source (or flow choke device), resistor-capacitors, current limiter, current chopping circuits, DC-DC converters, other passive/active current limiting devices, and the like, may be employed to control the current flow to the thermal target, thereby enhancing or decreasing the intensity of the target images as desired. The thermal profiles may be varied by changing the electrical flow to the Informational Image on a material, without additional structural or insulating materials to support an electrical current, thereby avoiding additional fabrication costs.

The Informational Image may include a unique pattern, as desired, that is designed to maximize uniformity of power dissipation of the image. The varying thermal profile of the Informational Image's pattern can generate a visible pattern or target when viewed with a device that converts radiated, transmitted and reflected heat energy into a visual image. Energy generated by the pattern of an Informational Image can be within the infrared ("IR") region of the electromagnetic spectrum. Both long and short wavelengths of the IR region can be detected by thermal imaging devices. The Informational Image emits a pattern seen via a thermal sensor or imaging device, based on the level of energy dissipated by the pattern, and based on the emissivity of the material that is conducting or radiating the thermal energy, i.e., the material which forms the pattern.

The Informational Image pattern can be constructed of at least one line or a plurality of continuous lines to create a desired image. The lines of pattern are formed of conductive ink, inks, or paints (referred to as "inks") which may include, for example, thermoset or thermoplastic polymers matrices, carbon matrices, silver or copper-doped inks, thermochromic inks, any thermal-conductive ink or conductive paint which may be visible with the use of a thermal imaging sensor, and the like. A conductive ink, or thermal conductive ink allows an electrical current to be induced throughout the Informational Image pattern as an electric potential is applied starting at end points, or the contact points, of the lines of the pattern. As power is dissipated by the inherent resistance of the conductive ink, this dissipation forms thermal energy. The thermal profile created by thermal dissipation along the conductive ink pattern in contrast with the underlying media forms an image visible with the use of a thermal sensor or imaging device. The underlying media or base material may be formed of an inexpensive disposable material, such as paper, vinyl, cardboard, corrugated board, plastic, fabric, cloth, fiber board, combinations of materials, and other media that can support an ink pattern. The underlying media may also be formed of durable or weather-resistant materials and/or laminated as desired. The conductive ink can be transferred onto the media in the desired pattern using any convenient method, including, but not limited to, silk screen, offset printing flexographic gravure and the like. Transfer of the desired pattern directly on the chosen media negates the necessity for additional insulating, media layers or laminates to map out conductive or insulated areas. The disposable media also does not require the addition of any type of structural layers, which avoids expensive fabrication and mass manufacture costs.

The lines of the thermal pattern define the electrical path of a current. The lines making up the image are continuous but not necessarily linear. Thicker parts of the pattern or shaded areas in the image are created by a compressed zigzag or oscillating pattern contained between the boundaries of the area. Shaded areas of the image formed of a single compressed oscillating line insure that the current flowing through these shaded areas is relatively uniform. This, in turn, insures that the thermal energy created by the current flowing in the shaded areas is relatively uniform as well. One or more continuous lines may be used to make up the desired image. Each line represents a series resistive circuit. When multiple lines are used the circuit becomes a series-parallel configuration. The resistance value of each individual line can be matched to maintain relative uniformity of current and therefore heat dissipation in different areas of the pattern region. This pattern can be formed into any desired image. Each line may represent a separate circuit and are powered by a common voltage source such as, but not limited to, a battery, a solar battery, a coin cell and/or a remote power source electrically connected to the Informational Image pattern via a contact point. When required, the power source could be designed to be a hidden, integral part of the assembly, such as for example, low profile coin cells which may be attached with adhesive to the back of a printed marker or target.

The electrical connections to the Informational Image may be attached at points in the pattern that complete the electrical circuit, i.e. a contact point. The contact points may be designed so that they to be easily connected to an electrical connection and/or at least one power source, and removed conveniently and typically with relative ease and without typically requiring the use of additional tools. Where the Informational Image is used in the field, the contact point may be directly attached to a coin cell, solar battery or any light weight, portable power source. Where an Informational Image is formed as a target, the contact assembly can be part of the target support and deployment mechanism and can have an integral power source such as a battery. The battery may be protected from ballistic objects or out of the line of fire. The electrical connections may be, but is not limited to, spring loaded alligator clips attached to wires that clip onto the target at areas in the pattern designed to offer access to either end of the electrical circuit, i.e. the contact points. The wires can be part of the support mechanism that attaches a paper target to a pulley and cable used to deploy and later retrieve the target for inspection. The power source and any other control electronics can be situated behind or inside a small protective ballistic shield or enclosure. They can also be unshielded and positioned remotely away from the ballistic projectile path and probable paths of ballistic ricochet.

A temperature variation profile between the conductive area and the non-conductive areas of an Informational Image is a function of a number of variables that include current flow through the Informational Image pattern and ambient temperature. The temperature differential is directly proportional with the variation in visual contrast shown in the Informational Image when viewed with the infrared sensor. Power source settings can be designed to adjust the current flow through the target to maximize target visibility and compensate for variations in ambient temperature, as necessary or desired. A choking source or flow choke device may be used to control, interrupt or stagger the current entering the Informational Image's thermal pattern. Other closed loop automated feedback systems can be used to automatically maintain a minimum temperature variation and maximize image contrast. This design may require additional temperature sensing devices to measure the variation in temperature between the conductive and non-conductive areas of the Informational Image and adjust the current automatically.

It should be understood that the foregoing descriptions are only illustrative of the disclosure. Various alternatives and modifications can be devised by those skilled in the art without departing from the disclosure. Accordingly, the present disclosure and invention is intended to embrace all such alternatives, modifications and variances which fall within the scope of the appended claims.

What is claimed is:

1. A covert sign to display an informational thermal image comprising:

a non-conductive underlying base material; multiple and different thermal image patterns formed on said non-conductive underlying base material, wherein said multiple and different thermal image patterns are formed of said at least one conductive ink; a source of electric power; wherein said multiple and different thermal image patterns may be selectively activated to change the informational thermal image, wherein each of said multiple and different thermal image patterns comprise a complete electric circuit when the source of electric power is connected thereto and when the source of electric power is connected, this allows a flow of electric current to said at least one conductive ink and forms said multiple and different thermal image patterns being supplied with electric current and wherein said source of electric power has settings to adjust said flow of current to maximize visibility of said multiple and different thermal image patterns and compensate for variations in ambient temperature.

2. The covert sign as in claim 1 wherein said multiple and different thermal image patterns are layered or overlaid with visible patterns, and wherein said multiple and different thermal image patterns are different from the visual patterns so as to provide additional covert information or are the same as said visible patterns so that said multiple and different thermal image patterns and said visible patterns are viewed by a thermal imager or the naked eye.

3. The covert sign as in claim 1, wherein said non-conductive underlying base material is disposable.

4. The covert sign as in claim 1, wherein the flow of electric current is controlled by a device is selected from the group consisting of a choking source, a flow choke device, resistor-capacitors, a current limiter, current chopping circuits, DC-DC converters, and passive/active current limiting devices.

5. The covert sign as in claim 1 wherein the multiple and different thermal image patterns comprise at least one line or a plurality of continuous lines.

6. The covert sign of claim 5 in which electrical connections to said multiple and different thermal image patterns are established by contact points to which the source of electric power is connected.

7. The covert sign as in claim 1 wherein said at least one conductive ink is selected from the groups consisting of silver-doped ink and copper-doped ink.

8. The covert sign as in claim 1 wherein said non-conductive underlying base material selected from the group consisting of paper, cardboard, corrugated board, plastics, vinyl, and fiber board.

9. The covert sign as in claim 1 wherein said covert sign can be used as a training practice aide for weapons and other devices that are equipped with thermal imaging equipment.

10. The covert sign as in claim 1 wherein said multiple and different thermal image patterns further include a pattern formed of conductive media and wherein the conductive media is selected from the group consisting of conductive foil, metallic materials and conductive-doped materials.

11. The covert sign as in claim 5 wherein said covert sign is a thermal target used as a training practice aide for weapons and other devices that are equipped with thermal imaging equipment.

12. The covert sign as in claim 11 wherein said multiple and different thermal image patterns further include a pattern formed conductive media and wherein the conductive media is selected from the group consisting of conductive foil, metallic materials and conductive-doped materials.

13. The covert sign as in claim 1 wherein said covert sign is an informational sign used as a target.

14. The covert sign as in claim 5 wherein said covert sign is an informational sign used as a target.

15. A covert sign to display an informational thermal image comprising: a non-conductive underlying base material; multiple and different thermal image patterns formed on said non-conductive underlying base material, wherein said multiple and different thermal image patterns are formed of at least one conductive ink; wherein the at least one conductive ink is selected from the group consisting of silver-doped ink and copper-doped ink; and a source of electric power; wherein said multiple and different thermal image patterns may be selectively activated to change the informational thermal image, wherein each of said multiple and different thermal image patterns comprise a complete electric circuit when the source of electric power is connected thereto and when the source of electric power is connected, this allows a flow of electric current to said at least one conductive ink and forms said multiple and different thermal image patterns being supplied with electric current, and wherein said source of electric power has settings to adjust said flow of current to maximize visibility of said multiple and different thermal image patterns and compensate for variations in ambient temperature.

16. The covert sign as in claim 15 wherein the flow of electric current is controlled by a device selected from the group consisting of a choking source, a flow choke device, resistor-capacitors, a current limiter, current chopping circuits, DC-DC converters, and passive/active current limiting devices.

17. The covert sign as in claim 15 wherein said multiple and different thermal image patterns are layered or overlaid with visible patterns, and wherein said multiple and different thermal image patterns are different from the visual patterns so as to provide additional covert information or are the same as said visible patterns so that said multiple and different thermal image patterns and said visible patterns are viewed by a thermal imager or the naked eye.

18. The covert sign as in claim 15 wherein said covert sign is an informational sign used as a target.

19. A covert sign to display an informational thermal image comprising: a non-conductive underlying base material; multiple and different thermal image patterns formed on said non-conductive underlying base material, wherein said multiple and different thermal image patterns are formed of conductive media, wherein the conductive media is selected from the group consisting of conductive foil, metallic materials and conductive-doped materials, and a source of electric power; wherein said multiple and different thermal image patterns may be selectively activated to change the informational thermal image, wherein each of said multiple and different thermal image patterns comprise a complete electric circuit when the source of electric power is connected thereto and when the source of electric power is connected, this allows a flow of electric current to said conductive media and forms said multiple and different thermal image patterns being supplied with electric current, and wherein said source of electric power has settings to adjust said flow of current to maximize visibility of said multiple and different thermal image patterns and compensate for variations in ambient temperature.

20. The covert sign as in claim 19 wherein said covert sign is an informational sign used as a target.

* * * * *